US007503717B2

(12) United States Patent
Gutberlet

(10) Patent No.: US 7,503,717 B2
(45) Date of Patent: Mar. 17, 2009

(54) COSMETIC STICK

(75) Inventor: Detlev Gutberlet, Aldorf (DE)

(73) Assignee: H & M Gutberlet GmbH, Nürnberg (DE)

( * ) Notice: Subject to any disclaimer, the term of this patent is extended or adjusted under 35 U.S.C. 154(b) by 20 days.

(21) Appl. No.: 11/767,695

(22) Filed: Jun. 25, 2007

(65) Prior Publication Data

US 2007/0297844 A1 Dec. 27, 2007

(30) Foreign Application Priority Data

Jun. 24, 2006 (DE) ..... 20 2006 009 893 U

(51) Int. Cl.
*B43K 21/18* (2006.01)

(52) U.S. Cl. ..... 401/66; 401/65; 401/179

(58) Field of Classification Search ..... 401/57, 401/65, 66, 87, 82, 83, 176, 179
See application file for complete search history.

(56) References Cited

U.S. PATENT DOCUMENTS

| | | | | |
|---|---|---|---|---|
| 1,628,974 | A * | 5/1927 | Hartman | 401/66 |
| 2,718,299 | A * | 9/1955 | Atwater et al. | 206/537 |
| 2,771,858 | A * | 11/1956 | Cribbs et al. | 401/66 |
| 4,778,300 | A | 10/1988 | French et al. | |
| 5,011,317 | A | 4/1991 | Gueret | |

FOREIGN PATENT DOCUMENTS

| | | |
|---|---|---|
| DE | 598358 | 6/1934 |
| DE | 804169 | 4/1951 |
| DE | 3909377 A1 | 9/1990 |

* cited by examiner

*Primary Examiner*—David J Walczak
(74) *Attorney, Agent, or Firm*—Browdy and Neimark, P.L.L.C.

(57) ABSTRACT

A cosmetic stick has a stick housing, a refill extendable therefrom out of a refill opening as well as a feed device for extending the refill. The refill is in push connection with a piston guided in the housing. The feed device has a piston push rod and an actuating push rod. The actuating push rod is in push connection with an actuating element. The actuating push rod is in push connection with the piston push rod via a pair of stops. A stop alternating device allows alternation between the first stop and one of a plurality of second stops. The stop alternating device has a driver body fixed to the actuating push rod. A ramp cooperates with the driver body. The ramp incline is such that the first stop disengages from the instantaneous second stop as soon as the driver body has covered an advance path which is at least identical to the distance between two adjacent second stops. A pretensioning spring biases the actuating push rod in an unactuated rest position. A cosmetic stick is produced, the production costs of which are reduced with a given operational reliability of the stop alternating device.

8 Claims, 6 Drawing Sheets

COSMETIC STICK

BACKGROUND OF THE INVENTION

1. Field of the Invention

The invention relates to a cosmetic stick with a stick housing, with a refill which may be moved out of the housing through a refill opening, with a feed device positioned in the housing for extending the refill, wherein the refill is in push connection with a piston guided in the housing, wherein the feed device comprises a piston push rod in push connection with the piston and positioned on the side of the piston remote from the refill, wherein the feed device further comprises an actuating push rod in push connection with an actuating element positioned on an end, opposite the refill opening, of the actuating push rod, wherein the actuating push rod is in push connection with the piston push rod via a pair of stops consisting of a first stop positioned on one of the two push rods, and a plurality of second stops positioned successively at an equal distance from one another axially along the other push rod, with a stop alternating device with which the first stop alternates between a second instantaneous stop of the second stops, with which the first stop instantaneously cooperates, and an axially adjacent second target stop, to advance the refill.

2. Background Art

A cosmetic stick of this type is known from U.S. Pat. No. 5,011,317 A. The stop alternating device in the aforementioned US patent is of a complex construction and imposes exacting requirements on the manufacturing tolerances and on the precise observance of the material parameters of the components involved to ensure reliable operation.

SUMMARY OF THE INVENTION

It is therefore an object of the present invention to develop a cosmetic stick of the type mentioned at the outset, such that the production costs are reduced with a given operational reliability of the stop alternating device.

This object is achieved according to the invention by a cosmetic stick having a stop alternating device comprising a driver body fixed to the actuating push rod, at least one ramp fixed to the housing and cooperating with the driver body, the ramp incline of said ramp being such that in an actuating position of the actuating push rod, the first stop disengages from the instantaneous stop as soon as the driver body has covered an advance path which is at least identical to the distance between two adjacent second stops, a pretensioning spring which biases the actuating push rod relative to the housing in an unactuated rest position in which the actuating element is pushed out of the housing.

It has been found according to the invention that a reliable stop alternation may be achieved using two cooperating actuating push rods, in that a relative movement between the two stops instantaneously together forming a pair of stops is intentionally produced by positively driving one of the two push rods over a ramp. In so doing, one drive rod is deflected with a movement component transversely to the longitudinal axis thereof during the positive driving. No standard model exists for this in the prior art. Overall, this allows a cosmetic stick with a housing construction in which the risk of sink marks caused by differences in the housing wall is minimised. The individual components of the cosmetic stick may be simply produced as injection moulded plastics material parts. Alternatively, it is possible to produce the stick housing and also a cap for covering the refill opening as metal components. Special tools for assembling the cosmetic stick, in particular screwing out tools for housing components or push rods are not required.

A distribution of the stops with the first stop being positioned on the actuating push rod and the second stop being positioned on the piston push rod provides a simple construction of the feed device. Alternatively, it is possible to provide the first stop on the piston push rod and the second stops on the actuating push rod.

A cosmetic stick in which the driver body has the first stop provides a compact construction of the feed device, since the functions of "ramp guidance" and "first stop" are combined in a compact manner on the driver body.

Contact portions where the push rods engage which are formed such that a return of the actuating push rod from the actuating position into the rest position is possible by the push rods sliding past one another, without the piston push rod being axially displaced relative to the housing as a result ensure that the piston push rod is not entrained, which is undesirable, during the return of the actuating push rod from the actuating position into the rest position. Securing the piston push rod in this manner may be further assisted by a corresponding friction of the piston push rod in a guide means provided through a passage opening in a component fixed to the housing.

A pretensioning spring being configured as a plastics material spring provides a simple construction of the cosmetic stick. The plastics material spring may also be produced as an injection moulded part and may integrate various functions. Thus, the plastics material spring may have in particular an intermediate bottom into which the passage opening is guided for guiding the movement of the piston push rod. When a plastics material pretensioning spring is used, a bayonet catch in particular is possible for joining on the one hand a cosmetic product housing portion, i.e. a refill housing portion, with on the other hand a feed housing portion, without openings of this connection which are required in terms of production consequently being visible from outside. A metal spring is not used.

A ramp being formed integrally with the pretensioning spring also enhances the compact nature of the arrangement, since an additional function integration takes place.

A guide means for guiding the axial movement of the push rods relative to one another provides a reliable and defined relative movement of the push rods during the feed activation.

A cup-shaped seat in the piston holding the refill ensures that the refill is held securely and also allows the cosmetic stick to be equipped in a simple manner with the refill.

Embodiments of the invention will be described hereinafter with reference to the drawings.

DESCRIPTION OF THE PREFERRED EMBODIMENTS

Figure 2:
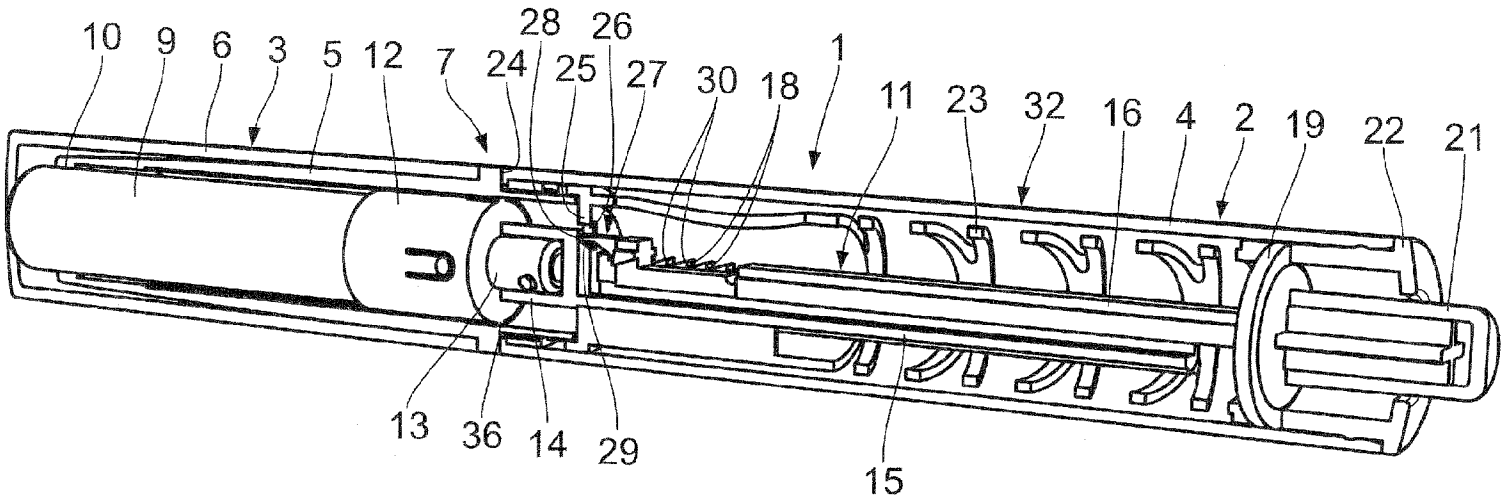
FIG. 2 shows a longitudinal section through the cosmetic stick according to FIG. 1.

A cosmetic stick 1 has a stick housing 2 with a cosmetic product housing portion 3 and a feed housing portion 4. The stick housing 2 with the cosmetic product housing portion 3 is produced from SAN-ABS. The cosmetic product housing portion 3 has a cone housing body 5 which is covered by a cap 6, for example when the cosmetic stick 1 is stored. FIG. 2 shows the cap 6 pushed onto the cone housing body 5, said cap 6 abutting against a peripheral collar 7 of the cone housing body 5. A slight undercut (not shown in more detail) of the cone housing body 5 and of the cap 6 ensure that the cap 6 is held with a positive fit, and thus secured, on the cone housing body 5 when resting on the peripheral collar 7. At the same time, a user may easily remove the cap 6 from the cone housing body 5.

Adjacent to the peripheral collar 7, the cone housing body 5 has bayonet segments 8 which face the feed housing portion 4 and catch in a corresponding inner peripheral recess in the feed housing portion 4 when the cone housing body 5 is assembled. The bayonet segments 8 form together with the corresponding bayonet seat in the feed housing portion 4 a bayonet catch for joining these two housing components. A catch connection is also possible instead of a bayonet catch.

A cosmetic product in the form of a refill 9 is positioned in the cone housing body 5. Said refill 9 may be moved out of the cone housing body 5 through a refill opening 10. A feed device 11 which is housed in the feed housing portion 4 and will be described in more detail hereinafter is used to extend the refill 9.

The refill 9 is in a push connection with a piston 12 guided in the cone housing body 5. In this respect, the refill 9 is held in a cup-shaped seat of the piston 12. The refill 9 has a diameter of 6 mm. The seat of the piston 12 has an inner diameter corresponding thereto. Other refill diameters are also possible. A refill diameter of 8 mm in particular is also possible. Formed on the piston 12 is a piston connecting component 13, the outer diameter of which is reduced in comparison to the outer diameter of the rest of the piston 12. Peripheral seats of a sleeve-shaped connecting component 14 of a piston push rod 15 are formed in complementary manner to bayonet segments of the piston connecting component 13. The piston push rod 15 is made of POM. The piston push rod 15 is in push connection with the piston 12 and is positioned on the side of the piston 12 remote from the refill 9. A positive, secure connection between the piston 12 and the feed device 11, to which the piston push rod 15 belongs, is produced via the bayonet connection formed by the connecting components 13 and 14.

An actuating push rod 16 also belongs to the feed device 11. Said actuating push rod 16 is in push connection with the piston push rod 15. The actuating push rod 16 is made of POM. Said push connection is produced via a pair of stops consisting of a first stop 17 positioned on the actuating push rod 16 and a plurality of second stops 18 positioned in succession at an equal distance from one another axially along the piston push rod 15. In the feed position shown in FIG. 2, the first stop 17 of the actuating push rod 16 cooperates with the second stop 18 in the furthest left-hand position shown in FIG. 2, so that the refill 9 is in a starting position with the piston 12 fully retracted into the stick housing 2.

Overall, there are two rows of second stops 18 at the same height, between which runs the actuating push rod 16. Where the actuating push rod 16 runs between the two rows of second stops 18 up to the piston push rod 15 facing the stop point 19, the two push rods 15, 16 are guided towards one another, so that a defined relative movement of the two push rods 15, 16 with respect to one another is possible. This guidance is carried out by a complementary cross-sectional configuration of adjacent portions of the push rods 15, 16. This guide means is a T groove guidance.

On its side remote from the piston 12, the actuating push rod 16 has a contact peripheral collar 19. The outer diameter of the contact peripheral collar 19 corresponds to the inner diameter of the feed housing portion 4. A free end 20, adjacent to the contact peripheral collar 19, of the actuating push rod 16 bears an operating button 21 as actuating element which is latched onto the free end 20. The operating button 21 protrudes, like an operating button for a ballpoint pen, out of the end, opposite the refill 9, of the feed housing portion 4. Latched into a housing opening in the feed housing portion 4, from which the operating button 21 protrudes, is a stopper 22 which is shaped like a sleeve and is penetrated by the operating button 21. The operating button 21 is made of SAN-ABS, as is the stopper 22. An inner end wall of the stopper 22 rests against the contact peripheral collar 19 of the actuating push rod 16. A plastics material pretensioning spring 23 rests against the contact peripheral collar 19 on the side opposite the stopper 22. The plastics material pretensioning spring 23 is made of POM. At its opposite free end, the plastics material pretensioning spring 23 is supported against an inwardly projecting peripheral collar 24 of the feed housing portion 4. This peripheral collar 24 is closely adjacent to a dividing line between the feed housing portion 4 and the cone housing body 5.

The plastics material pretensioning spring 23 has an intermediate bottom 25 adjacent to the end wall of the free end, carrying the bayonet segment 8, of the cone housing body 5. Said intermediate bottom 25 has an approximately rectangular passage opening 26 through which the piston push rod 15 passes.

A stop alternating device 27 is a component of the feed device 11. To advance the refill 9, the stop alternating device 27 alternates the first stop 17 between one of the second stops 18, with which the first stop 17 instantaneously cooperates and which is also called the second instantaneous stop, and an axially adjacent other second stop 18 which is also called the target stop. The stop alternating device has a driver body 28 formed on the free end facing the piston 12, of the actuating push rod 16. The driver body 28 supports the two first stops 17, positioned at the same height, on both sides like wing stumps.

A ramp 29 cooperates with the driver body 28. Said ramp 29 is configured in the intermediate bottom 25 of the plastics material pretensioning spring 23 which in turn is fixed on the feed housing portion 4. The ramp 29 is therefore fixed on the stick housing 2.

The plastics material pretensioning spring 23 also belongs to the stop alternating device 27. The second stops 18 positioned axially behind one another and at an equal distance from one another are configured in the manner of saw teeth. The flank of this saw tooth configuration which is steep in each case and vertical in practice forms the second stops 18.

Oblique wall portions 30 run between these perpendicular wall portions. The incline of these oblique wall portions 30 with respect to a longitudinal axis of the stick housing 2 is sufficiently low for the wing stumps of the driver body 28 to be able to push on the oblique wall portions 30 in a direction opposite the feed direction, without the piston push rod 15 being axially displaced relative to the stick housing 2 as a result.

The cosmetic stick 1 is assembled as follows:

First of all, the plastics material pretensioning spring 23 is pushed into the feed housing portion 4 until it meets the stop collar 24. A ridge on the stopper side of the feed housing portion 4 cooperating with a corresponding groove in the periphery of the plastics material pretensioning spring 23 ensures that the plastics material pretensioning spring 23 can be pushed into the feed housing portion 4 only in a predetermined orientation. The inner diameter of the feed housing portion 4 is coordinated with the outer diameter of the plastics material pretensioning spring 23, such that both parts easily clamp together in the assembly end position. The piston push rod 15 is then introduced into the plastics material pretensioning spring 23. This is carried out from the left-hand side in FIG. 2. In this respect, the position and the cross section of the passage opening allow only a correct introduction orientation of the piston push rod 15 into the plastics material pretensioning spring 23. Said piston push rod 15 is introduced into the plastics material pretensioning spring 23 until the push rod connecting component 14 of the piston push rod 15 abuts against the intermediate bottom 25 of the plastics material pretensioning spring 23. The actuating push rod 16, already provided with the attached operating button 21, is then inserted into the feed housing portion 4 from the right-hand side in FIG. 2 and threaded in terms of guidance into the complementary guidance of the piston push rod 15. When the actuating push rod 16 is pushed into the feed housing portion 4, the first stop 17 of the actuating push rod 16 engages initially with the second stop 18, in the furthest right-hand position in FIG. 3, of the piston push rod 15. During further insertion, the actuating push rod 16 pushes the piston push rod 15 ahead of it until the driver body 28 of the actuating push 16 runs onto the ramp 29. In so doing, the first stop 17 disengages from the second instantaneous stop 18. The piston push rod 15 may then be pushed back to the right-hand side in FIG. 2 until it reaches the starting position. The stopper 22 is then pushed and latched into the feed house portion 4. In so doing, the plastics material spring is lightly biased between the peripheral collar 19 and the peripheral collar 24.

When the operating button 21 is actuated, in other words when the operating button 21 is pushed into the stick housing 2, the piston push rod 15 is advanced by the actuating push rod 16 through the engagement of the first stop 17 with a second instantaneous stop 18, initially by an advance path which at least equals the distance between two second stops 18. After this advance path, the driver body 28 has run onto the ramp 29 to such an extent that the first stop 17 disengages from the second instantaneous stop 18. Further advance of the piston push rod 15 therefore does not take place, irrespective of whether the operating button 21 is pressed further into the stick housing 2. When the operating button 21 is released, it is pushed back again into the rest position shown in FIG. 2 due to the bias of the plastics material pretensioning spring 23 until the peripheral collar 19 rests against the stopper 22. During this pushing back action, the driver body 28 pushs on the oblique wall portions 30 of the piston push rod 15. In so doing, the piston push rod 15 is not displaced axially relative to the stick housing 2, such that in the rest position of the operating button 21, the first stop 17 is then able to engage with the second target stop 18 which is axially adjacent to the previous second instantaneous stop 18, more specifically is axially adjacent on the right-hand side in FIG. 2.

Figure 4:
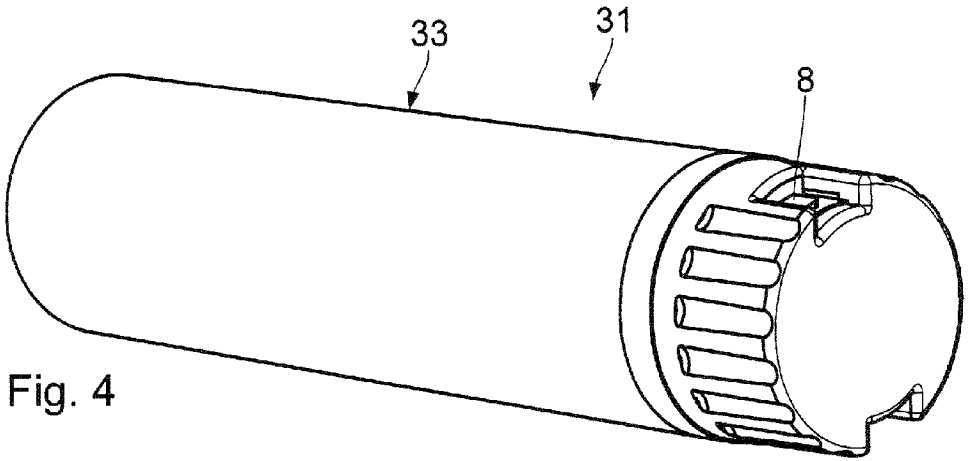
FIG. 4 shows a perspective view of a cosmetic product replacement unit for a base stick module of the cosmetic stick according to FIG. 1 to 3.
Figure 5:
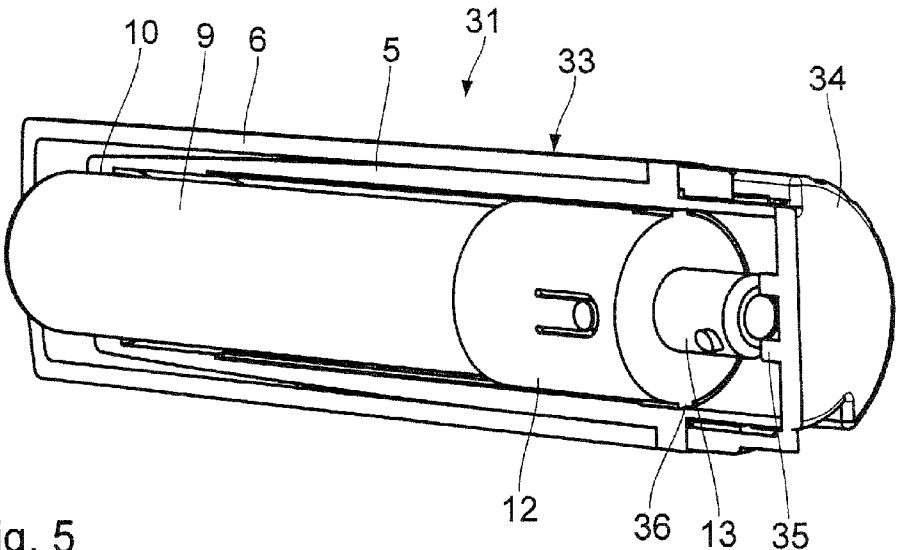
FIG. 5 shows an axial longitudinal section through the cosmetic product replacement unit according to FIG. 4.
Figure 6:
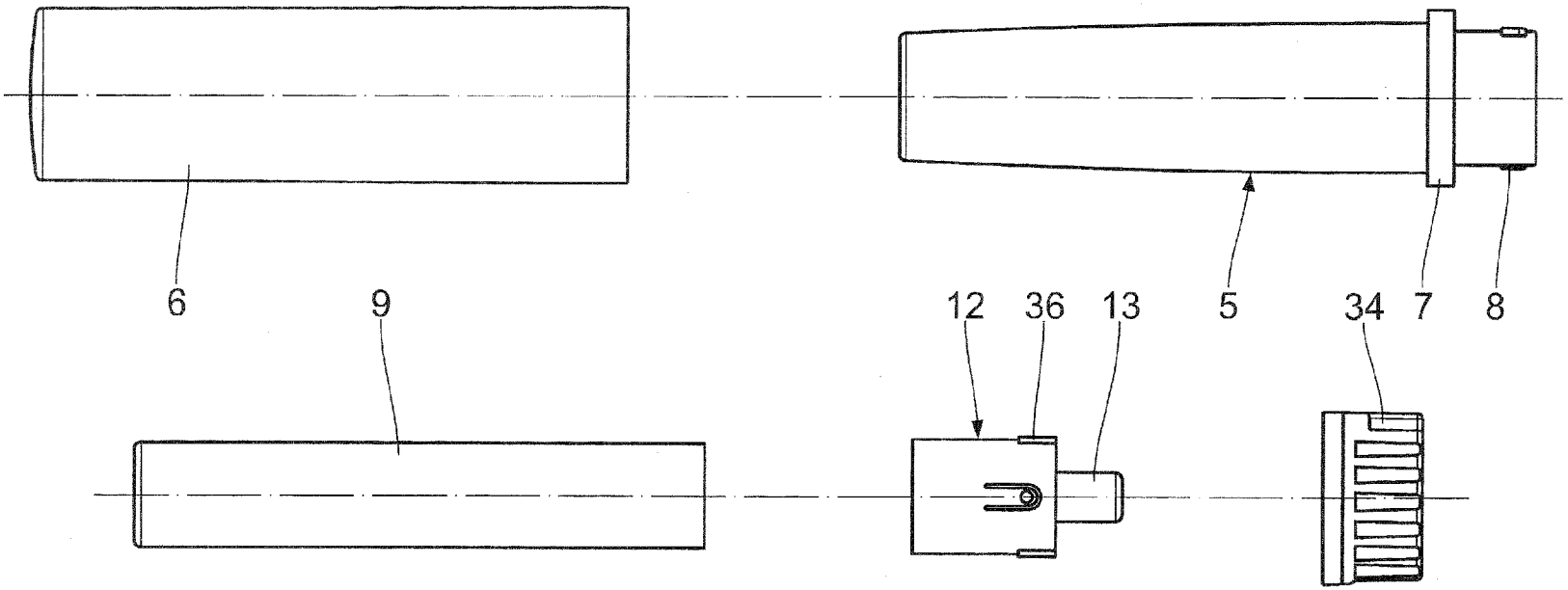
FIG. 6 shows a view of the cosmetic product replacement unit similar to that of FIG. 3.

FIG. 4 to 6 show a cosmetic product replacement unit 31 for a base stick module 32 of the cosmetic stick 1. The base stick module 32 includes all the components of the cosmetic stick 1 except for the cosmetic product housing portion 3, the piston 12 and the refill 9.

The cosmetic product replacement unit 31 has a replacement housing 33 which is identical to the cosmetic product housing portion 3, i.e. it has the cone housing body 5 and the cap 6. A sealing cap 34 positioned on the replacement housing 33 and secured thereto via a bayonet catch seals the replacement housing 33 on the side of the piston 12. The sealing cap 34 is made of polypropylene (PP). A support 35 formed on the base of the sealing cap 34 in the region of the stick housing longitudinal axis is used for the defined contact of the piston connecting component 13. Positioned in the replacement housing 33 of the cosmetic product replacement unit 31 are the refill 9 and the piston 12 in the same orientation and position to the cone housing body 5 as in the cosmetic product housing portion 3 of the cosmetic stick 1.

The cosmetic product replacement unit 31 is assembled as follows: first of all the piston 12 is pushed with guiding seat opening leading into the cone housing body 5, more specifically from the side on which the bayonet segments 8 are located on the cone housing body 5. Ridges 36 formed on the outer wall of the piston 12 run in this respect in axial grooves in the inner wall of the cone housing body 5, such that the piston 12 is safeguarded against twisting in the cone housing body 5. A latching formed by complementarily formed latch elements on the piston 12 on the one hand and on the cone housing body 5 on the other hand indicates the assembly end position of the piston 12 in the cone housing body 5. The sealing cap 34 is then fitted on the cone housing body 5 via the bayonet connection. The refill 9 is then introduced into the seat in the piston 12 and finally the cap 6 is placed on the cone housing body 5.

To replace a cosmetic product housing portion 3 with a new cosmetic product replacement unit 31 when the refill 9 is used up, the bayonet connection between the cosmetic product housing portion 3 and the feed housing portion 4 is released. The sealing cap 34 is removed from the cosmetic product replacement unit 31 and said replacement unit 31 is connected to the feed housing portion 4 of the cosmetic stick 1. In so doing, a bayonet connection is simultaneously produced between the replacement housing 33 and the feed housing portion 4 on the one hand and between the piston connecting components 13 and the push rod connecting component 14. The cosmetic stick 1 is then ready for use again with a new refill 9.

Figure 7:
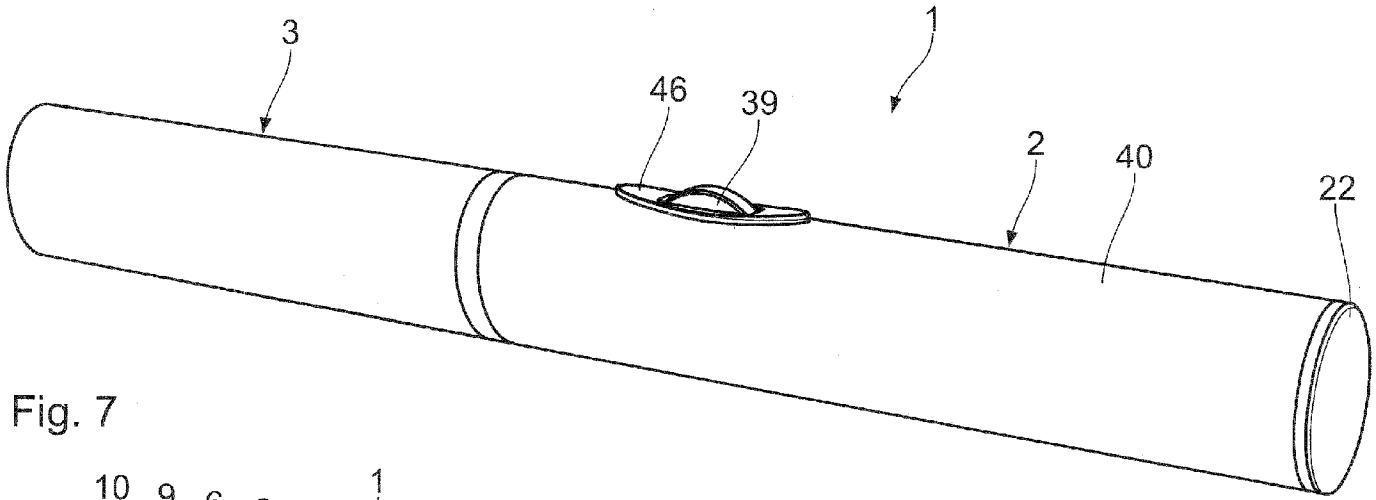
FIG. 7 shows a perspective side view of another cosmetic stick with a different base stick module having a feed device for the cosmetic product, said feed device differing in respect of its mechanical active principles from the feed device of the base stick module of the cosmetic stick according to FIG. 1.
Figure 8:
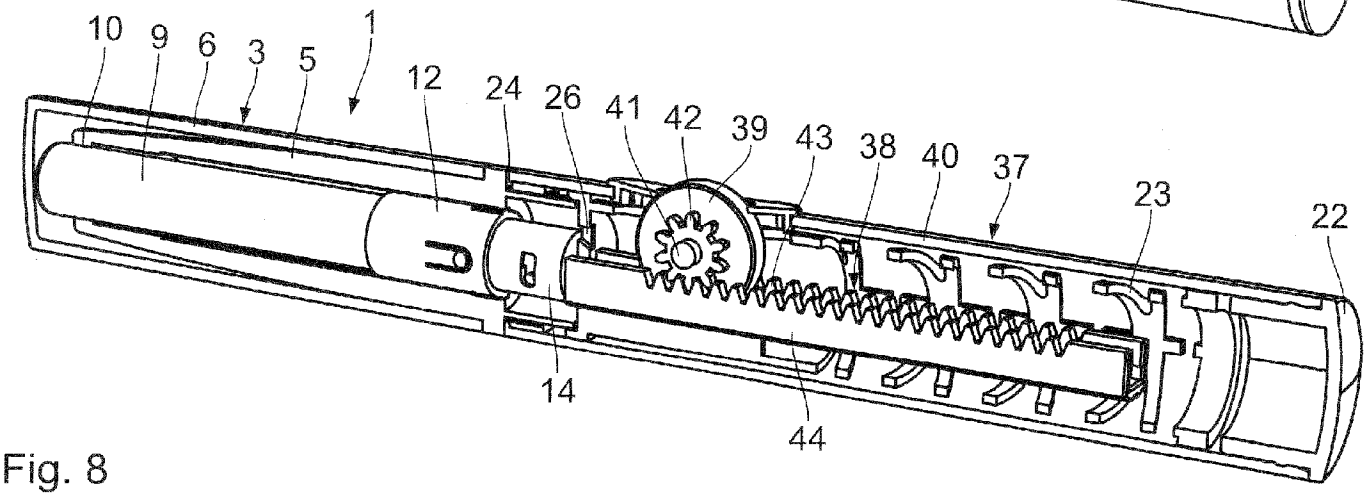
FIG. 8 shows an axial longitudinal section of the cosmetic stick according to FIG. 7.
Figure 9:
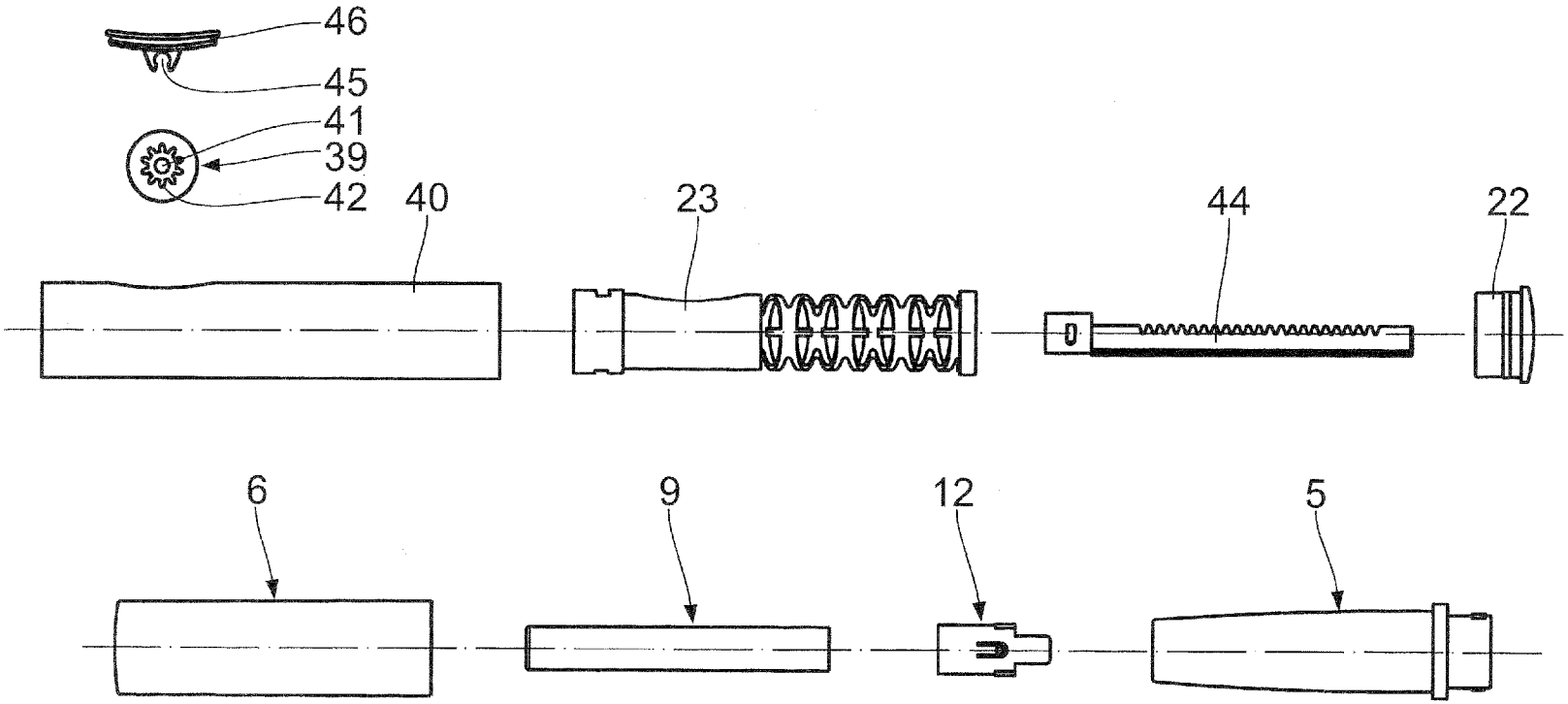
FIG. 9 shows a view, similar to FIG. 3, of the individual components of the cosmetic stick according to FIG. 7.

FIG. 7 to 9 show another variant of a cosmetic stick, wherein the cosmetic product replacement unit 31 may also be used. Components corresponding to those previously described hereinbefore with reference to FIG. 1 to 6 have been given the same reference numerals and will not be described again in detail.

A base stick module 37 of the cosmetic stick according to FIG. 7 to 9 has a feed device 38 with an actuating wheel 39. A circumferential portion of said actuating wheel 39 protrudes out of a feed housing portion 40 of the cosmetic stick 1 according to FIG. 7 to 9. The actuating wheel 39 is made of SAN-ABS as is the feed housing portion 40. Gear wheels 42 are formed integrally in each case with the actuating wheel 39 on bearing journals 41 guided on both sides out of the actuating wheel 39. The gear wheels 42 mesh with two rack portions 43, running parallel to each other, of a piston push rod 44 of the cosmetic stick 1 according to FIG. 7 to 9. The piston push rod 44 is made of POM. Formed integrally with the rack portions 43, facing the piston 12, is the push rod connecting body 14 which is configured identically to the piston rod connecting body 14 of the embodiment according to FIG. 1 to 3. The piston push rod 14 here again passes through the passage opening 26 in the plastics material pretensioning spring 23.

The bearing journals 41 of the actuating wheel 39 are latched into latch seats 45 of a screen housing portion 46. The screen housing portion 46 is made of SAN-ABS. Said screen housing portion 46 which surrounds the actuating wheel 39 is here again latched into a mounting in the feed housing portion 40.

For the assembly of the cosmetic stick 1 according to FIG. 7 to 9, the plastics material pretensioning spring 23 is also initially introduced into the feed housing portion 40, as described in connection with the assembly of the cosmetic stick 1 according to FIG. 1 to 3. The stopper 22 is then pushed from the right-hand side in FIG. 8 into the feed housing portion 40 and is latched therein. The piston push rod 44 is then introduced into the plastics material pretensioning spring 23 through the passage opening 26 from the left-hand side in FIG. 8. The actuating wheel 39 is latched into the latch seat 45 in the screen housing portion 46 and the screen housing portion 46 is then latched into the seat in the feed housing portion 40. The refill 9 may be pushed out of the refill opening 10 or may be pushed back again into the stick housing 2 by turning the actuating wheel 39.

Figure 1:
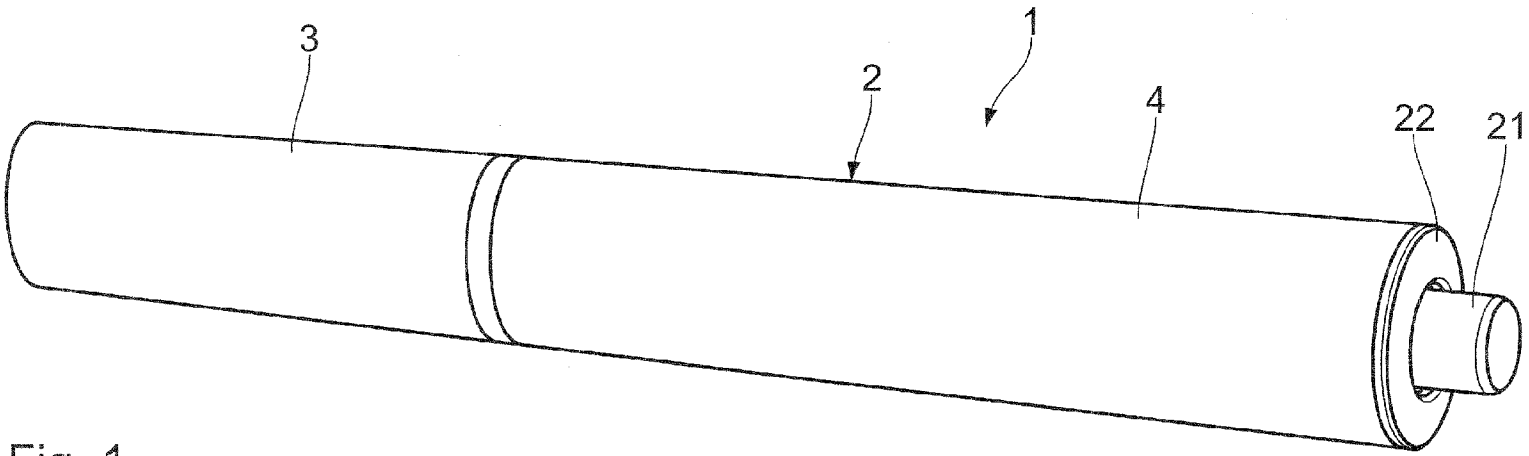
FIG. 1 shows a perspective view of a cosmetic stick.
Figure 3:
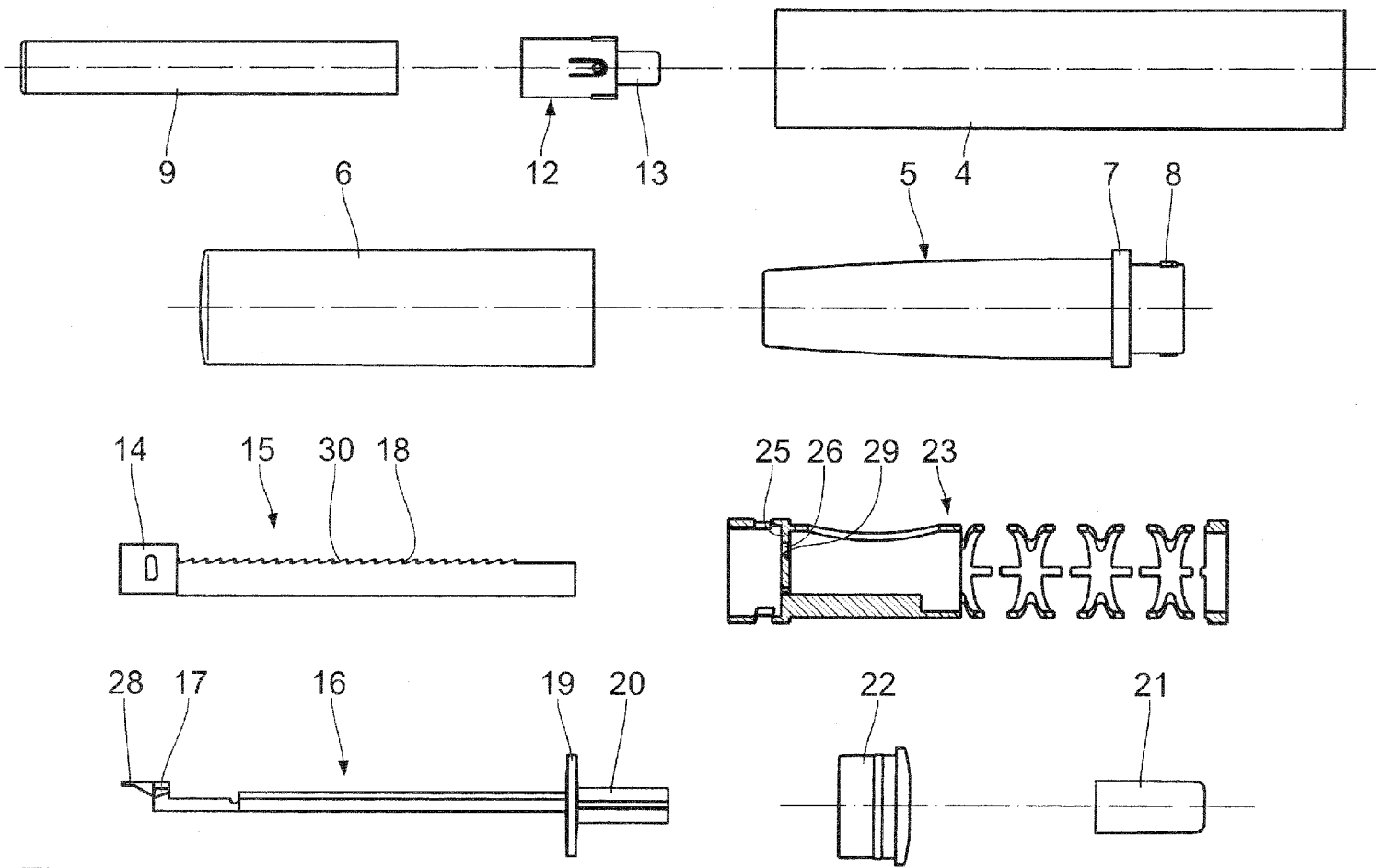
FIG. 3 shows comparable to an exploded view all the individual components for assembling the cosmetic stick according to FIG. 1.

In both embodiments, i.e. in the embodiment according to FIG. 1 to 3 with the operating button 21 to advance the refill and in the embodiment according to FIG. 7 to 9 with the actuating wheel 39 to advance the refill, the profile cross-section of the piston push rod 15 and 44 is coordinated with the inner cross-section of the passage opening 26 in the plastics material pretensioning spring such that a friction action occurs in the guidance through the passage opening 26 during the movement of the piston push rods 15 and 44. In the embodiment according to FIG. 1 to 3, this friction is greater than the friction between the piston push rod and the actuating push rod 16. This contributes to the fact that the piston push rod 15 is not entrained by the activating push rod 16, which is undesirable, during the return of the actuating push rod 16 from the actuating position into the rest position. In the embodiment according to FIG. 7 to 9, the effect of the friction between the piston push rod 44 and the inner wall of the passage opening 26 is that a certain axial pressure may be exerted on the refill 9 during use, without this resulting in the refill 9 being pushed back undesirably into the stick housing 2.

What is claimed is:

1. A cosmetic stick (1)

with a stick housing (2), with a refill (9) which may be moved out of the housing (2) through a refill opening (10), with a feed device (11) positioned in the housing (2) for extending the refill (9), wherein the refill (9) is in push connection with a piston (12) guided in the housing (2), wherein the feed device (11) comprises a piston push rod (15) in push connection with the piston (12) and positioned on the side of the piston (12) remote from the refill (9), an actuating push rod (16) in push connection with an actuating element (21) positioned on an end, opposite the refill opening (10), of the actuating push rod (16), wherein the actuating push rod (16) is in push connection with the piston push rod (15) via a pair of stops (17, 18)

consisting of a first stop (17) positioned on one of the two push rods (15, 16), and a plurality of second stops (18) positioned successively at an equal distance from one another axially along the other push rod (16, 15), with a stop alternating device (27) with which the first stop (17) alternates between a second instantaneous stop of the second stops (18), with which the first stop (7) instantaneously cooperates, and an axially adjacent second target stop (18), to advance the refill, wherein the stop alternating device (27) comprises a driver body (28) fixed to the actuating push rod (16), at least one ramp (29) fixed to the housing (2) and cooperating with the driver body (28), the ramp incline of said ramp (29) being such that in an actuating position of the actuating push rod (16), the first stop (17) disengages from the instantaneous stop (18) as soon as the driver body (28) has covered an advance path which is at least identical to the distance between two adjacent second stops (18), a pretensioning spring (23) which biases the actuating push rod (16) relative to the housing (2) in an unactuated rest position in which the actuating element (21) is pushed out of the housing (2).

2. A cosmetic stick according to claim 1, wherein the first stop (17) is positioned on the actuating push rod (16) and the second stops (18) are positioned on the piston push rod (15).

3. A cosmetic stick according to claim 2, wherein the driver body (28) has the first stop (17).

4. A cosmetic stick according to claim 1, wherein contact portions (17, 30) where the push rods (15, 16) engage are formed such that a return of the actuating push rod (16) from the actuating position into the rest position is possible by the push rods (15, 16) sliding past one another, without the piston push rod (15) being axially displaced relative to the housing as a result.

5. A cosmetic stick according to claim 1, wherein the pretensioning spring (23) is configured as a plastics material spring.

6. A cosmetic stick according to claim 1, wherein the ramp (29) is formed integrally with the pretensioning spring (23).

7. A cosmetic stick according to claim 1, wherein the push rods (15, 16) have, at least in portions, a guide means for guiding the axial movement thereof relative to one another.

8. A cosmetic stick according to claim 1, wherein the refill (9) is held in a cup-shaped seat in the piston (12).

* * * * *